US012687374B2

(12) United States Patent
Cheng

(10) Patent No.: US 12,687,374 B2
(45) Date of Patent: Jul. 21, 2026

(54) MODULAR PISTOL

(71) Applicant: KRISS Systems SA, Etoy (CH)

(72) Inventor: Li-Te Cheng, Taipei City (TW)

(73) Assignee: KRISS SYSTEMS SA, Etoy (CH)

( * ) Notice: Subject to any disclaimer, the term of this patent is extended or adjusted under 35 U.S.C. 154(b) by 0 days.

(21) Appl. No.: 18/972,708

(22) Filed: Dec. 6, 2024

(65) Prior Publication Data

US 2026/0160519 A1 Jun. 11, 2026

(51) Int. Cl.
*F41C 23/10* (2006.01)
*F41A 3/66* (2006.01)

(52) U.S. Cl.
CPC ..... *F41C 23/10* (2013.01); *F41A 3/66* (2013.01)

(58) Field of Classification Search
CPC ..... F41C 23/10; F41C 23/14
See application file for complete search history.

(56) References Cited

U.S. PATENT DOCUMENTS 11,320,234 B1 * 5/2022 Simon ..... F41A 17/20

* cited by examiner

*Primary Examiner* — J. Woodrow Eldred
(74) *Attorney, Agent, or Firm* — Bennet K. Langlotz; Langlotz Patent & Trademark Works, LLC

(57) ABSTRACT

A modular pistol has a frame having an elongated grip portion, a linear grip interface on the elongated grip portion, a first element configured to slidably engage a first portion of the linear grip interface, and a second element configured to slidably engage a second portion of the linear grip interface. The linear grip interface may be a track having a constant cross-sectional profile. The linear grip interface may be on a rear portion of the elongated grip portion. The first element may be configured to slide over the second portion of the linear grip interface and reside on the first portion of the linear grip interface. The first and second elements may abut each other. The first element may be a beavertail. The second element may be a backstrap. The first and second elements may each have a flush contoured surface continuous with each other.

11 Claims, 11 Drawing Sheets

MODULAR PISTOL

FIELD OF THE INVENTION

The present invention relates to firearms, and more particularly to a modular pistol that enables the beavertail and backstrap portions of the grip to be easily and quickly customized to a user's preferences.

BACKGROUND AND SUMMARY OF THE INVENTION

The function of a firearm's grip is to provide a secure and stable hold for the shooter, allowing the shooter to control the firearm accurately by minimizing movement and directing recoil force effectively towards the hand and arm, ultimately leading to better shot placement and control over the firearm. The grip serves as the primary point of contact for the shooter's hand to maintain aim and stability during firing.

Because of variations in the size of shooters' hands and differences in how high shooters prefer to grip a firearm, different grip sizes and shapes can be preferred from one shooter to another. Conventional firearms typically have a single piece grip with a fixed shape and profile. The only way to customize the fit of the grip to the shooter's hand is to replace the entire grip with a different one.

Therefore, a need exists for a new and improved modular pistol that enables the beavertail and backstrap portions of the grip to be easily and quickly customized to a user's preferences. In this regard, the various embodiments of the present invention substantially fulfill at least some of these needs. In this respect, the modular pistol according to the present invention substantially departs from the conventional concepts and designs of the prior art, and in doing so provides an apparatus primarily developed for the purpose of enabling the beavertail and backstrap portions of the grip to be easily and quickly customized to a user's preferences.

The present invention provides an improved modular pistol, and overcomes the above-mentioned disadvantages and drawbacks of the prior art. As such, the general purpose of the present invention, which will be described subsequently in greater detail, is to provide an improved modular pistol that has all the advantages of the prior art mentioned above.

To attain this, the preferred embodiment of the present invention essentially comprises a frame having an elongated grip portion, a linear grip interface on the elongated grip portion, a first element configured to slidably engage a first portion of the linear grip interface, and a second element configured to slidably engage a second portion of the linear grip interface. The linear grip interface may be a track having a constant cross-sectional profile. The linear grip interface may be on a rear portion of the elongated grip portion. The first element may be configured to slide over the second portion of the linear grip interface and reside on the first portion of the linear grip interface. The first and second elements may abut each other. The first element may be a beavertail. The second element may be a backstrap. The first and second elements may each have a flush contoured surface continuous with each other. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
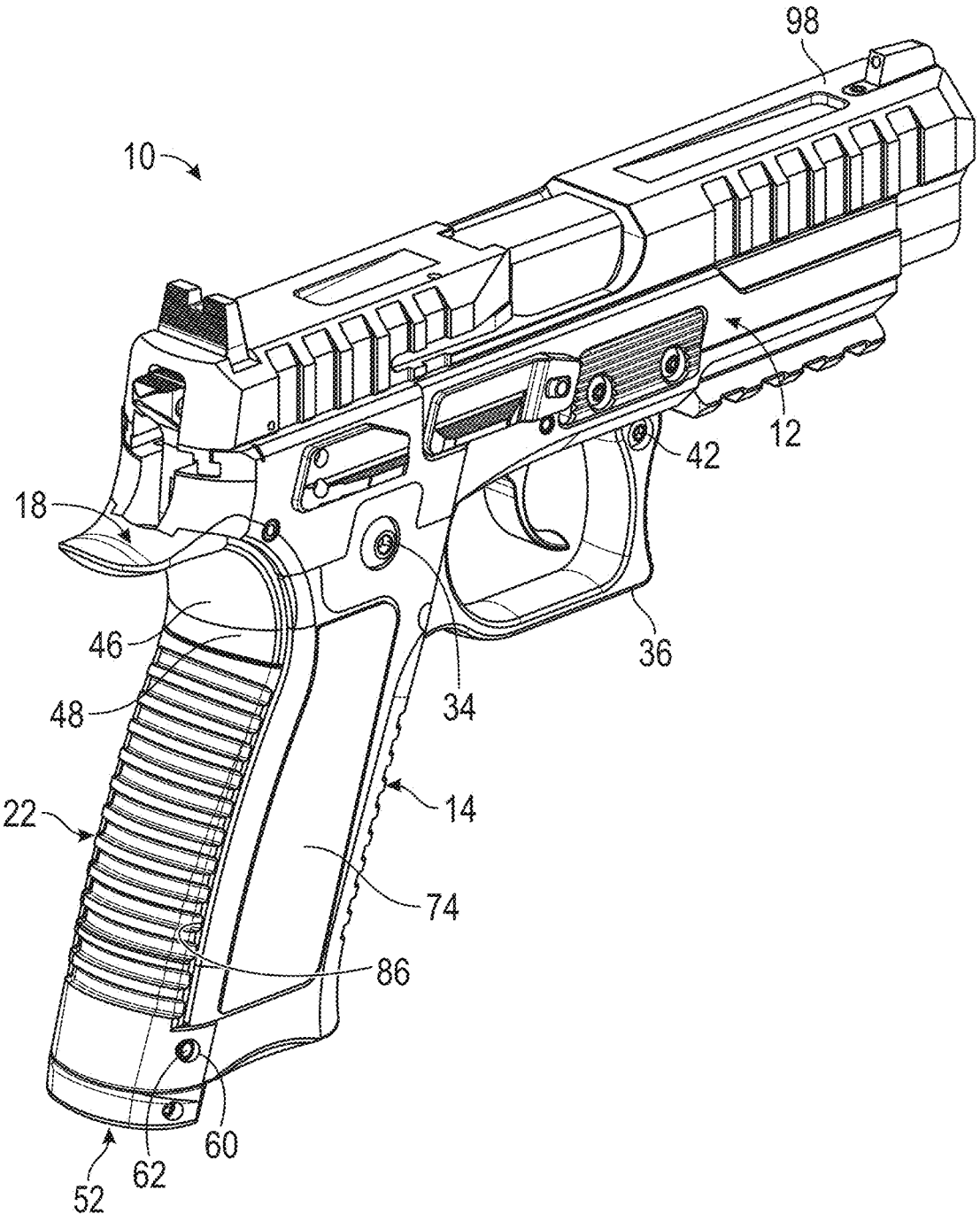
FIG. 1 is a top isometric view of the current embodiment of a modular pistol constructed in accordance with the principles of the present invention.

An embodiment of the modular pistol of the present invention is shown and generally designated by the reference numeral 10.

Figure 2A:
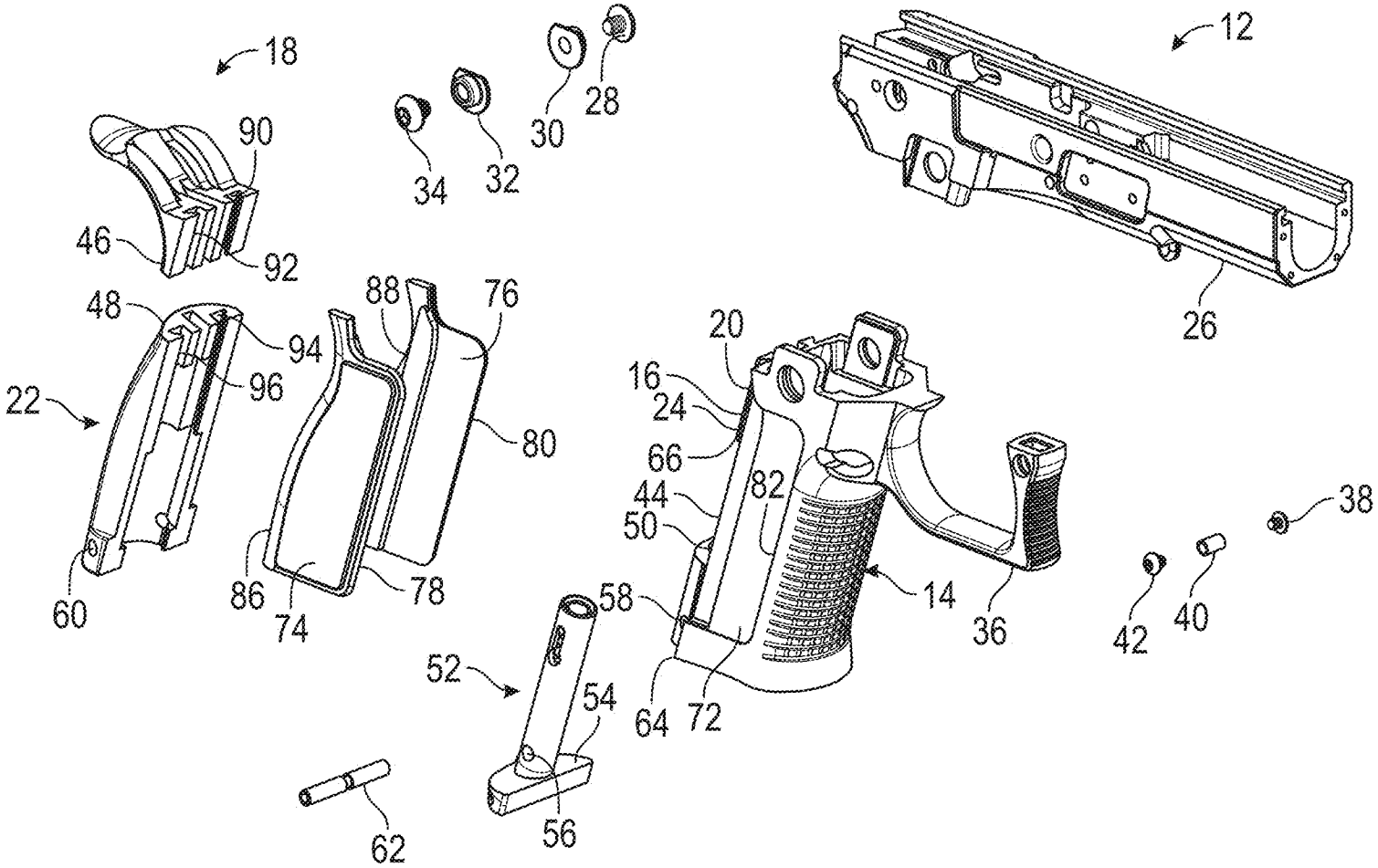
FIG. 2A is a front exploded view of the frame of the modular pistol of FIG. 1.
Figure 2B:
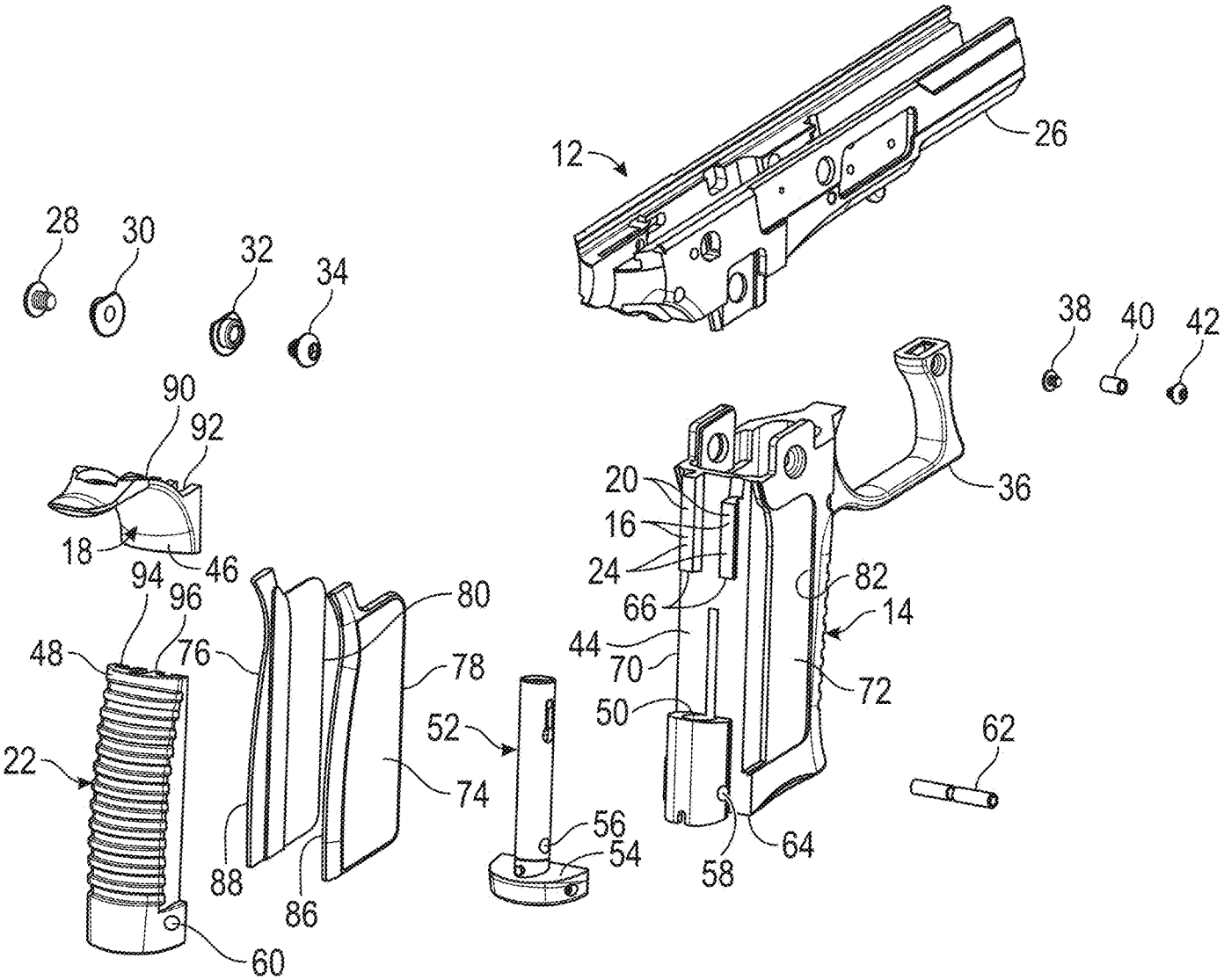
FIG. 2B is a rear exploded view of the modular pistol of FIG. 1.

FIG. 1 illustrates the improved modular pistol 10 of the present invention. FIGS. 2A-2B illustrate the improved frame 12 of the present invention. More particularly, the modular pistol has a frame 12 having an elongated grip portion 14. There is a linear grip interface 16 on the elongated grip portion. A first element 18 is configured to slidably engage a first portion 20 of the linear grip interface. A second element 22 is configured to slidably engage a second portion 24 of the linear grip interface. The frame includes a frame rail portion 26 that is removably connected to the elongated grip portion by fasteners 28, 30, 32, 34 and is removably connected to a trigger guard portion 36 of the frame by fasteners 38, 40, 42.

The linear grip interface 16 is a track having a constant cross-sectional profile in the current embodiment. The linear grip interface is on a rear portion 44 of the elongated grip portion. The first element 18 is a beavertail, and the second element 22 is a backstrap. The first and second elements abut each other, and each has a flush contoured surface 46, 48 continuous with each other.

The elongated grip portion 14 defines an aperture 50 receiving a spring element 52. In the current embodiment, the spring element is a hammer spring housing. The spring element has an upper surface 54 abutting the second element 22. The spring element defines an aperture 56. The elongated grip portion 14 defines an aperture 58. The second element defines an aperture 60. A pin 62 is received in apertures 56, 58, and 60 to secure the spring element to the frame.

Figure 9A:
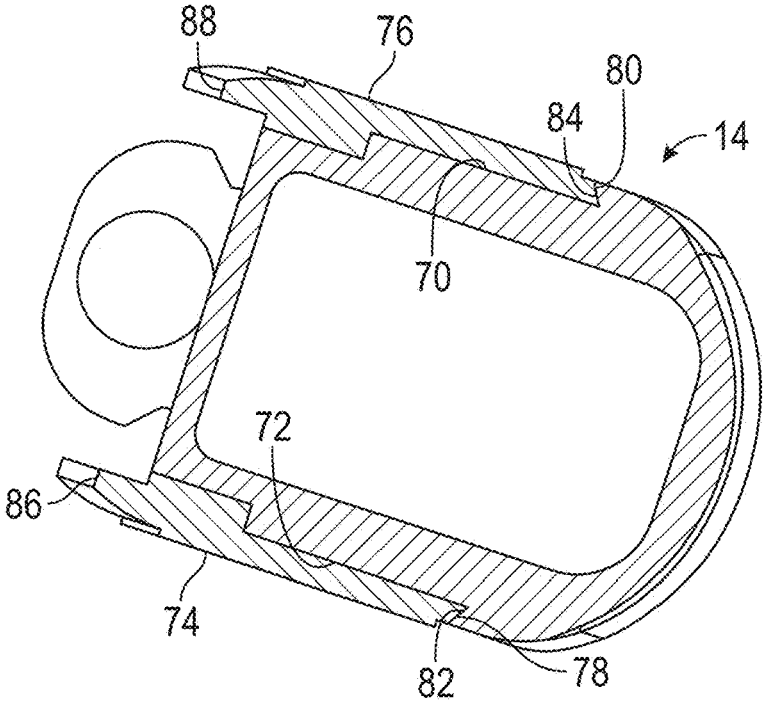
FIG. 9A is a sectional view of the frame of the modular pistol of FIG. 1 taken along line 9A-9A of FIG. 8.
Figure 9B:
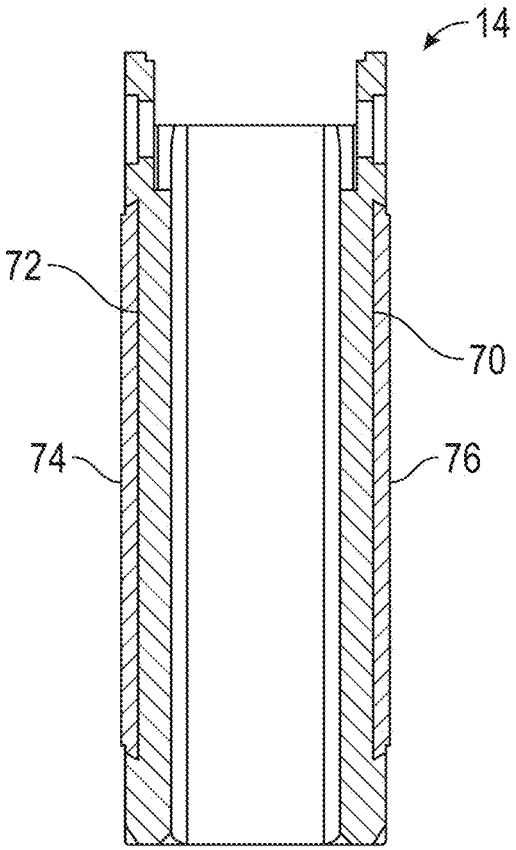
FIG. 9B is a sectional view of the frame of the modular pistol of FIG. 1 taken along line 9B 9B of FIG. 8.

The elongated grip portion 14 has a lower free end 64. The linear grip interface 16 has a lower track end 66 spaced apart from the lower free end. The elongated grip portion defines left and right recesses 70, 72 that receive right and left grip panels 74, 76. The right and left grip panels each have a forward tapered edge 78, 80 that tucks under and engages the elongated grip portion at 82, 84 (shown in FIG. 9A). The second element 22 abuts the rear edges 86, 88 of the right and left grip panels to hold the right and left grip panels within the left and right recesses. The first element also assists with retention of the right and left grip panels within the left and right recesses.

Figure 3:
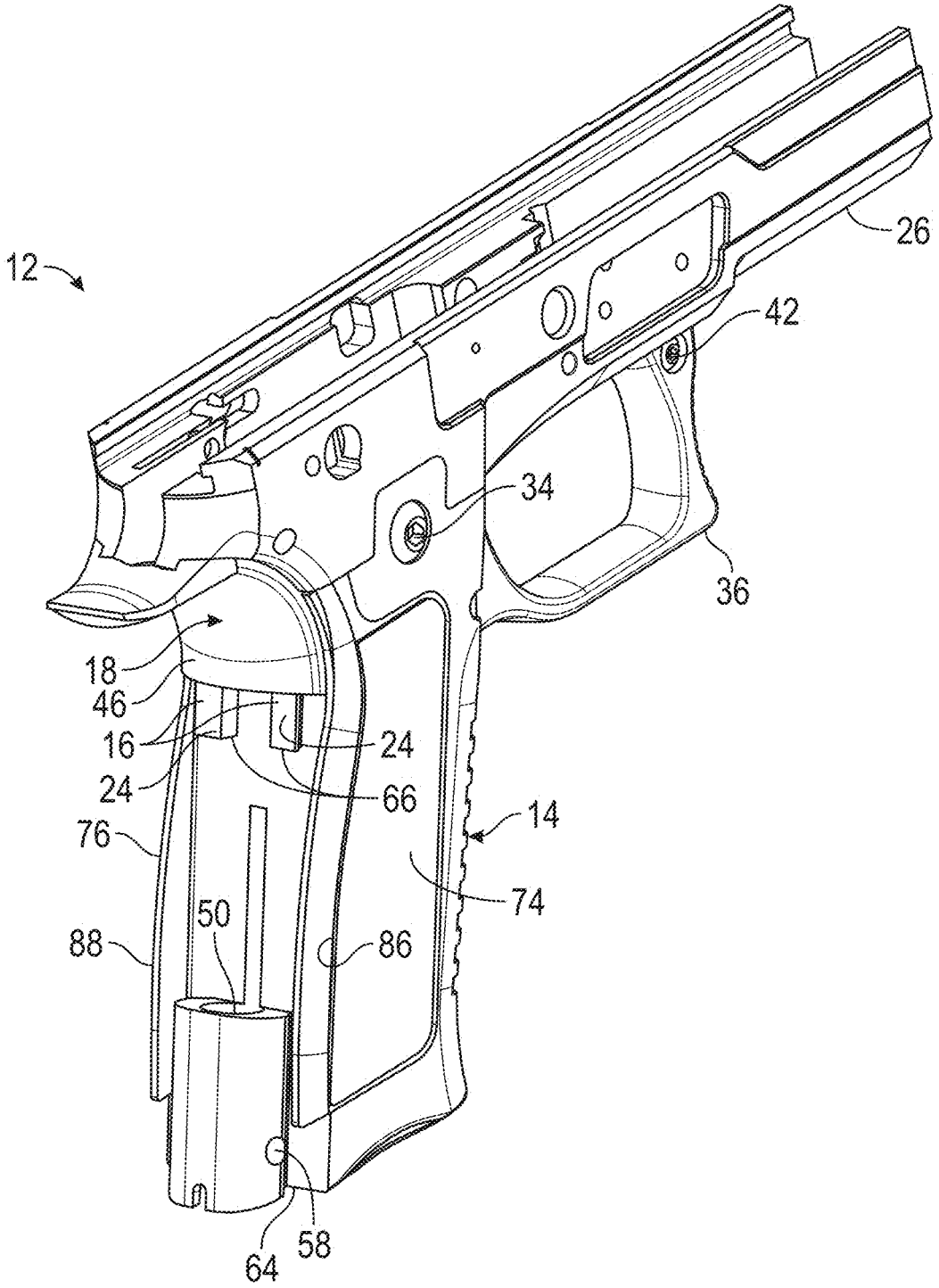
FIG. 3 is a top isometric view of the frame of the modular pistol of FIG. 1 with the first element installed and the second element detached.
Figure 4:
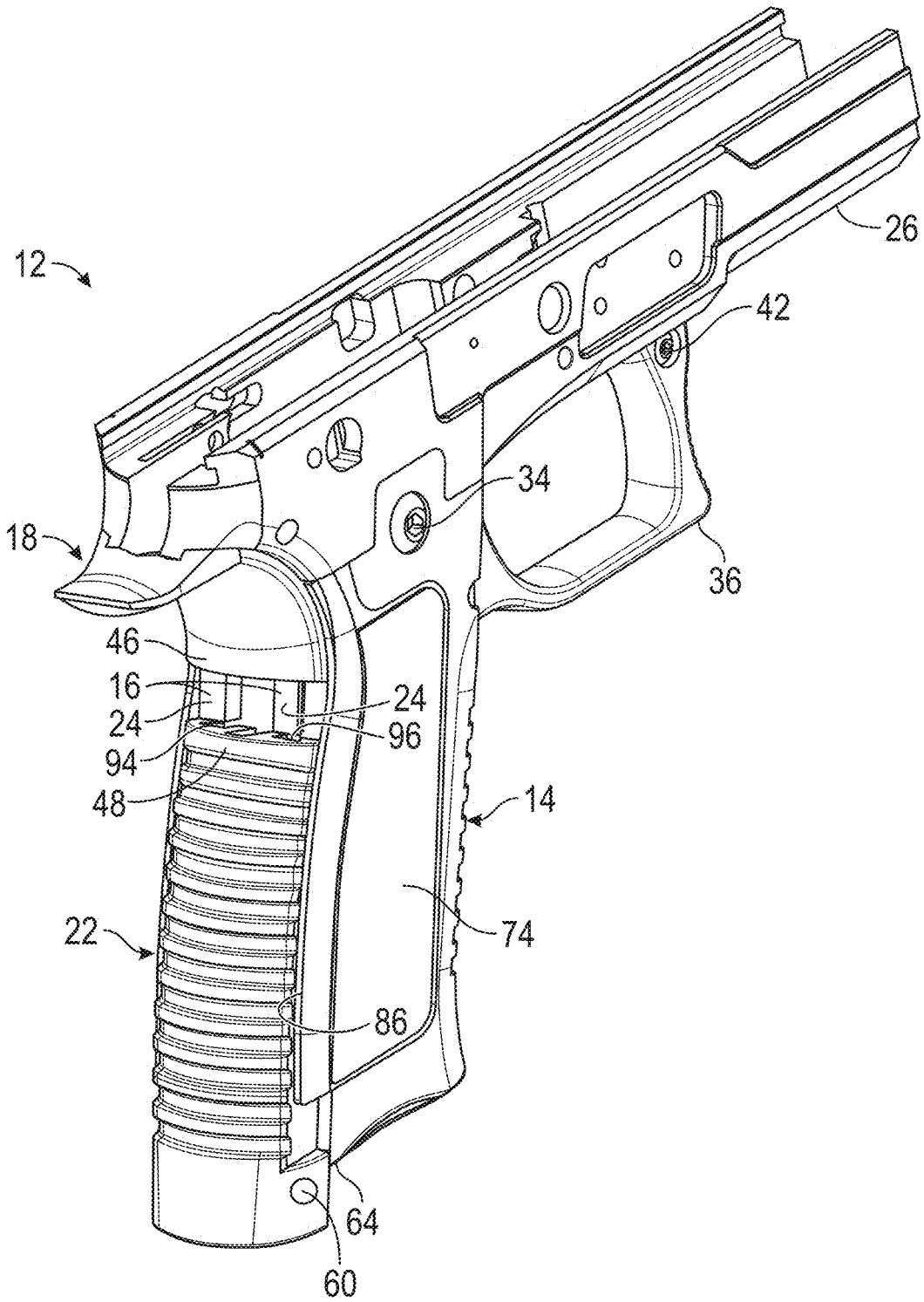
FIG. 4 is a top isometric view of the frame of the modular pistol of FIG. 1 with the first element installed and the second element partially installed.
Figure 5:
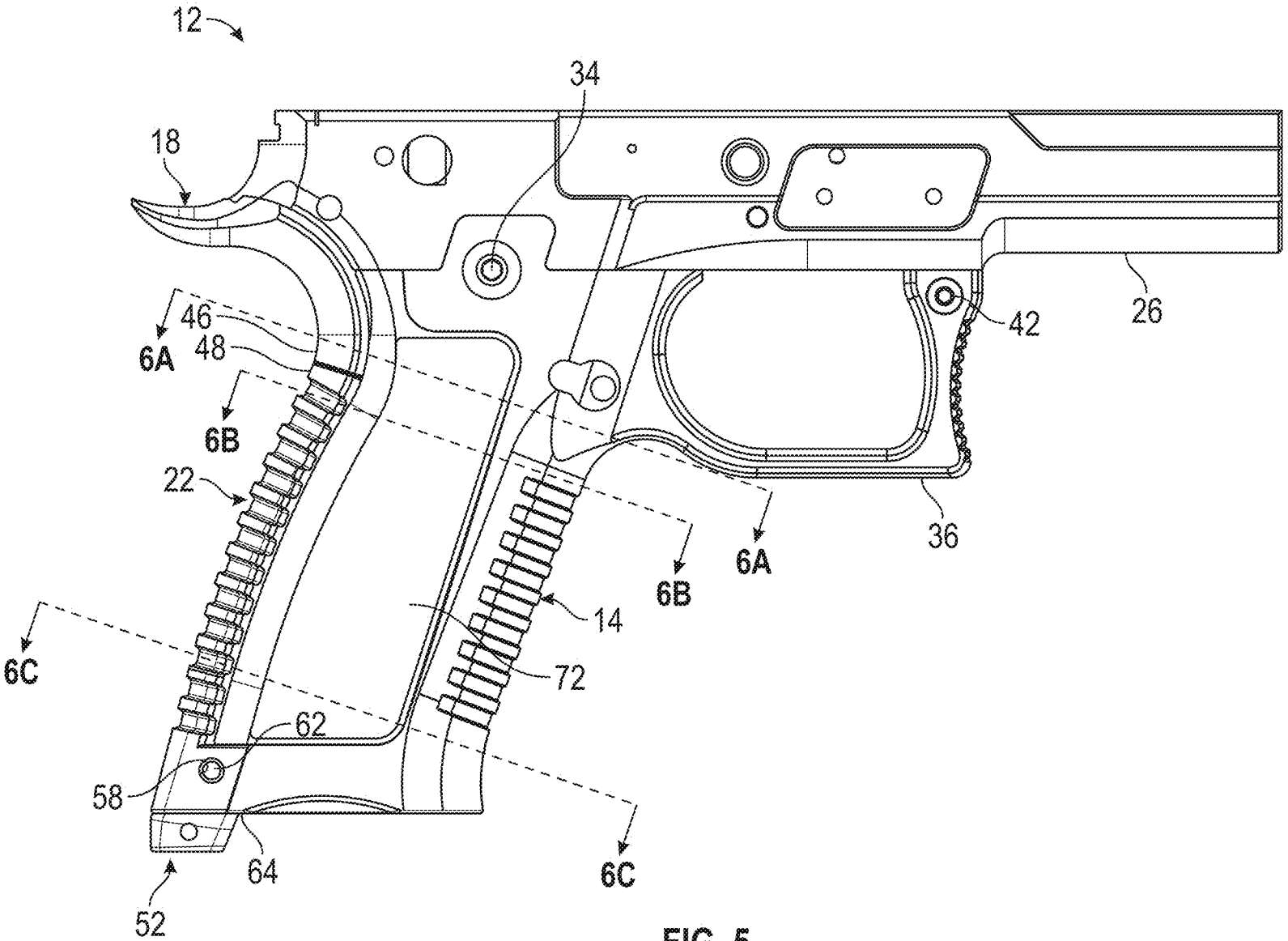
FIG. 5 is a right side view of the modular pistol of FIG. 1.
Figure 6A:
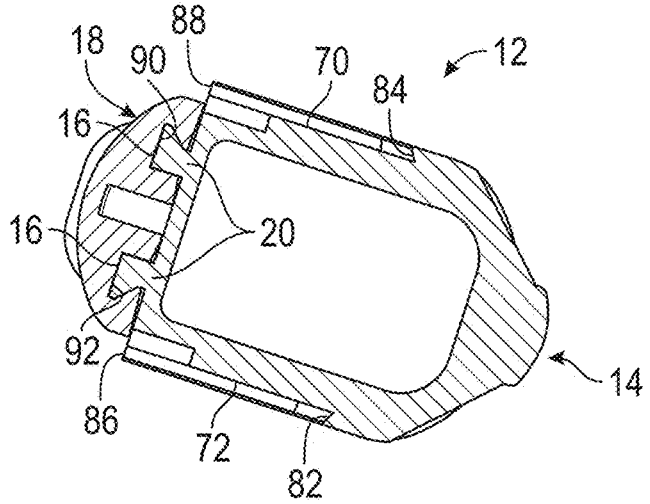
FIG. 6A is a sectional view of the modular pistol of FIG. 1 taken along line 6A-6A of FIG. 5.
Figure 6B:
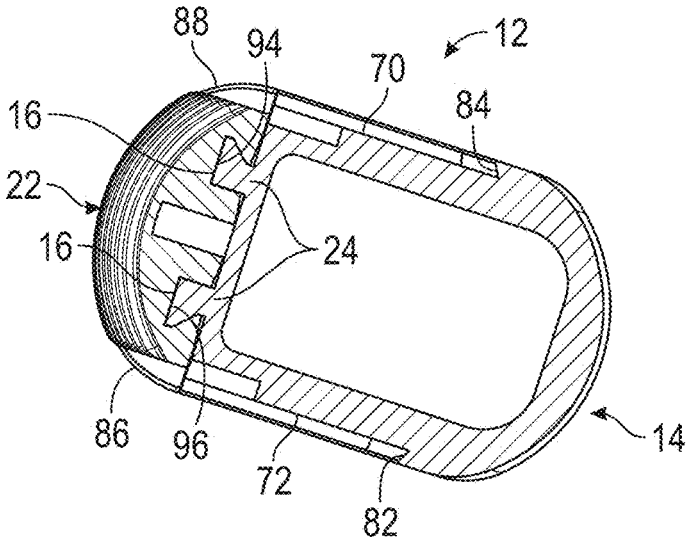
FIG. 6B is a sectional view of the modular pistol of FIG. 1 taken along line 6B-6B of FIG. 5.
Figure 6C:
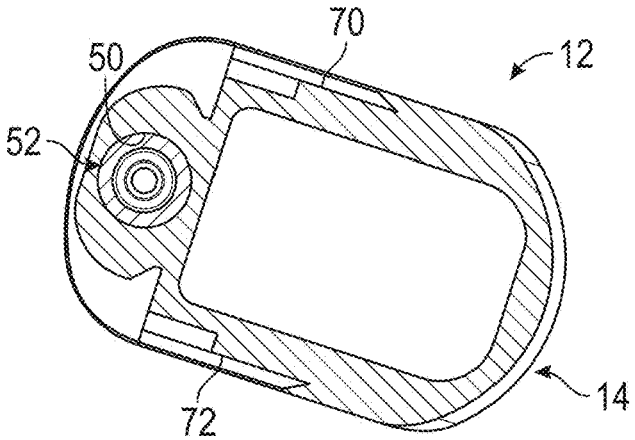
FIG. 6C is a sectional view of the modular pistol of FIG. 1 taken along line 6C-6C of FIG. 5.
Figure 6D:
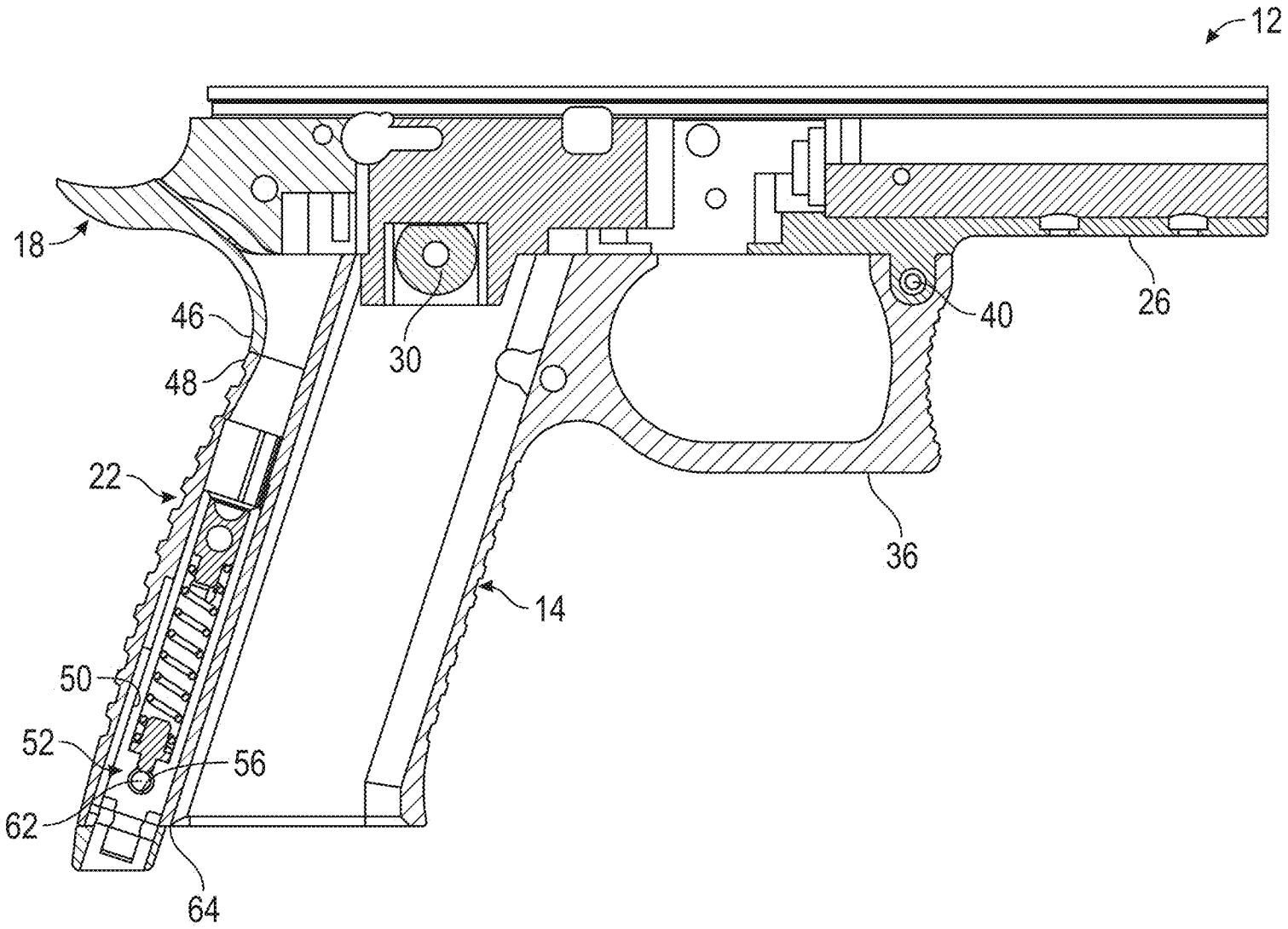
FIG. 6D is a right side sectional view of the modular pistol of FIG. 1.

FIGS. 3-6D & 8-9B illustrate the assembly process and assembled condition of the improved frame 12 of the present invention. More particularly, FIG. 3 shows the installation of the first element 18, and FIGS. 4 & 5 show the installation of the second element 22. The first element is installed first by sliding dovetail slots 90, 92 defined by the first element upward onto the linear grip interface 18. The first element is slid upwards into flush contact with the frame rail portion 26 of the frame 12 such that the first portion 20 of the linear grip interface is received in the dovetail slots 90, 92. Thus, the first element is configured to slide over the second portion of the linear grip interface and reside on the first portion of the linear grip interface. Then, the second element is installed by sliding dovetail slots 94, 96 defined by the second element upward onto the linear grip interface. The second element is slid upwards to abut the first element such that the second portion 24 of the linear grip interface is received in the dovetail slots 94, 96. Subsequently, the spring element 52 is inserted into aperture 50 until the upper surface 54 abuts the second element 22. The spring element is then secured in place by pin 62, which also prevents downward movement of the first and second elements. It should be appreciated that installation of the right and left grip panels 74, 76 in left and right recesses 70, 72 precedes installation of the first and second elements.

Figure 7:
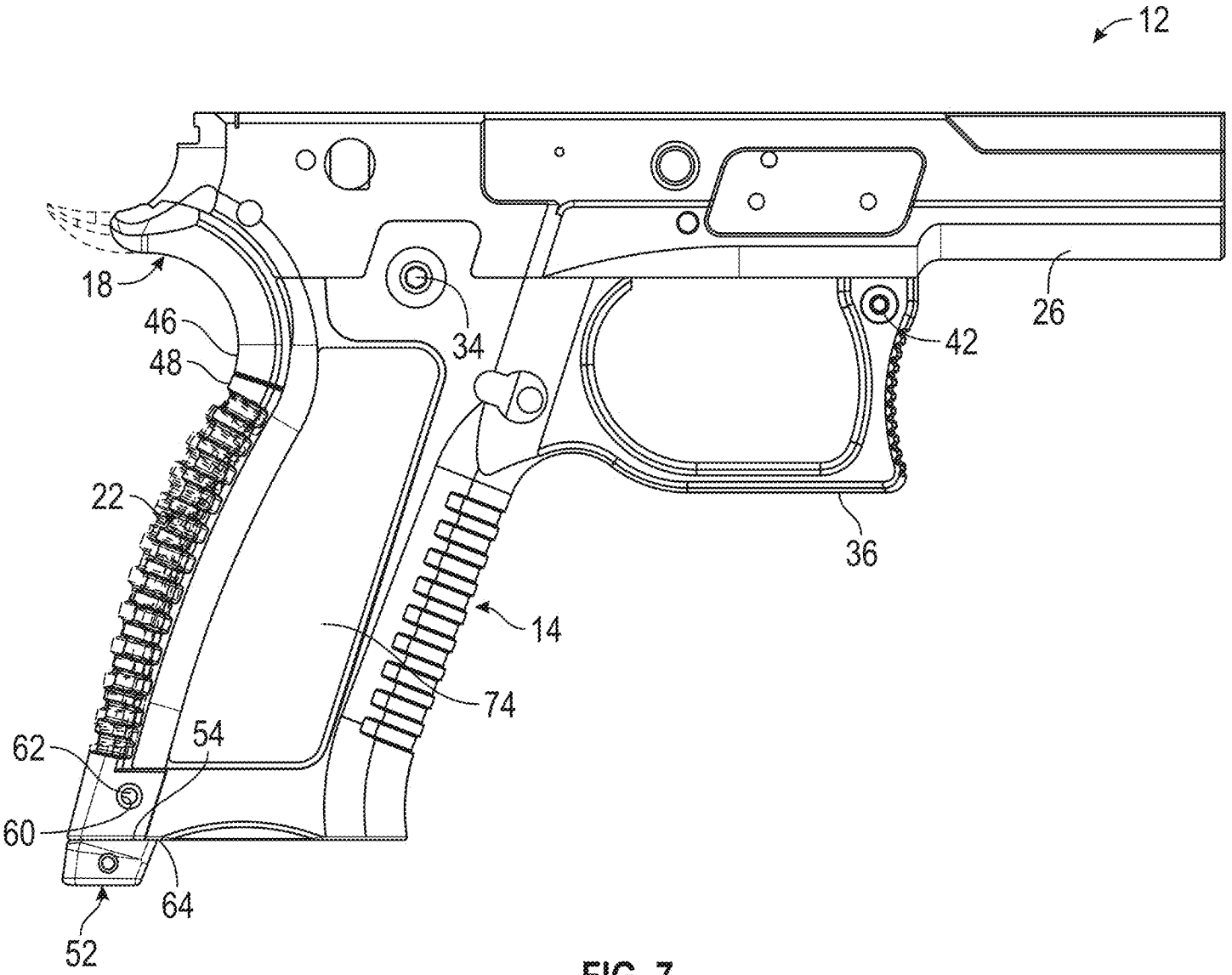
FIG. 7 is a right side view of the modular pistol of FIG. 1 showing an alternative beavertail and alternative backstrap contours enabled by the installation of different first and second elements.
Figure 8:
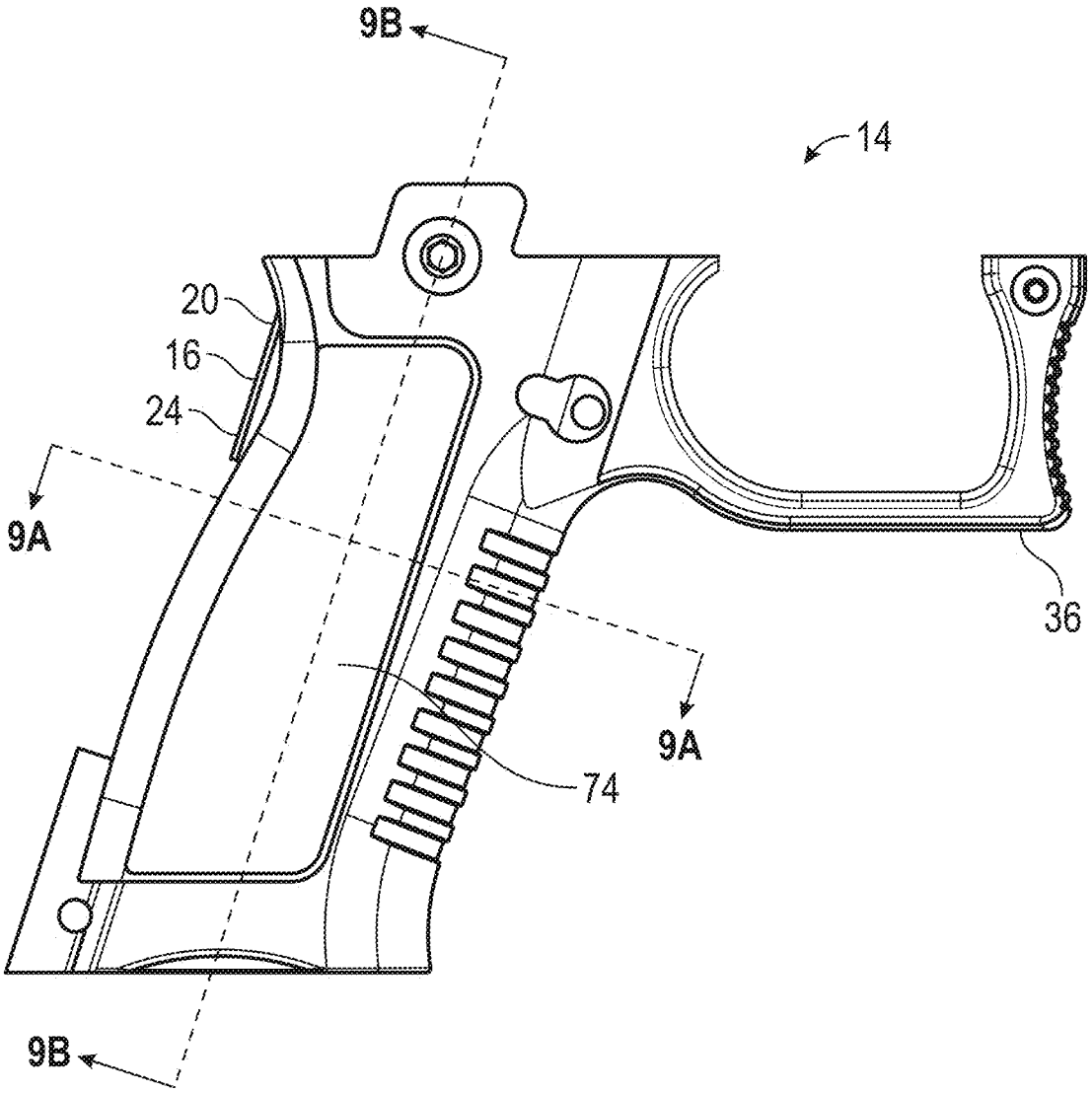
FIG. 8 is a right side partial view of the frame of the modular pistol of FIG. 1.

FIG. 7 illustrates the improved frame 12 of the present invention. More particularly, the ability to customize the modular pistol is denoted by the solid and dashed lines showing different shapes and contours of first elements 18 and second elements 22 that can be interchangeably installed. Shooters having large hands and/or a high grip location preference can install a larger first element to prevent the slide 98 from injuring the web of the shooter's hand and/or a larger second element for a more secure grip. Shooters having small hands and/or a lower grip location preference can install a smaller first element and/or a smaller second element.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a modular pistol has been described in detail, it should be apparent that modifications and variations thereto are possible, all of which fall within the true spirit and scope of the invention. Although pistols have been disclosed, the modular pistol grip characteristics are also suitable for use with rifles, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pistol comprising:

a frame having an elongated grip portion;

a linear grip interface on the elongated grip portion;

a first element configured to slidably engage a first portion of the linear grip interface; and a second element configured to slidably engage a second portion of the linear grip interface.

2. The pistol of claim 1 wherein the linear grip interface is a track having a constant cross-sectional profile.

3. The pistol of claim 1 wherein the linear grip interface is on a rear portion of the elongated grip portion.

4. The pistol of claim 1 wherein the first element is configured to slide over the second portion of the linear grip interface and reside on the first portion of the linear grip interface.

5. The pistol of claim 1 wherein the first and second elements abut each other.

6. The pistol of claim 1 wherein the first element is a beavertail.

7. The pistol of claim 1 wherein the second element is a backstrap.

8. The pistol of claim 1 wherein the first and second elements each has a flush contoured surface continuous with each other.

9. The pistol of claim 1 wherein the elongated grip portion defines an aperture receiving a spring element.

10. The pistol of claim 9 wherein the spring element has an upper surface abutting the second element.

11. The pistol of claim 1 wherein the elongated grip portion has a lower free end, and wherein the linear grip interface has a lower track end spaced apart from the lower free end.

* * * * *